US005124119A

United States Patent [19]

Grensing

[11] Patent Number: 5,124,119

[45] Date of Patent: Jun. 23, 1992

[54] METHOD OF MAKING BERYLLIUM-BERYLLIUM OXIDE COMPOSITES

[75] Inventor: Fritz C. Grensing, Perrysburg, Ohio

[73] Assignee: Brush Wellman Inc., Cleveland, Ohio

[21] Appl. No.: 654,328

[22] Filed: Feb. 12, 1991

[51] Int. Cl.[5] ..... B22F 3/26

[52] U.S. Cl. ..... 419/19; 419/27; 419/28; 419/30; 419/33; 419/49; 419/29; 419/23; 419/57; 75/235

[58] Field of Search ..... 419/19, 49, 28, 30, 419/33, 27, 29, 23, 57; 75/235

[56] References Cited

U.S. PATENT DOCUMENTS

| | | | |
|---|---|---|---|
| 3,779,714 | 12/1973 | Nadkarni et al. | 75/206 |
| 3,893,844 | 7/1975 | Nadkarni | 75/206 |
| 4,077,816 | 3/1978 | Nadkarni | 75/206 |
| 4,274,873 | 6/1981 | Nadkarni | 75/206 |

*Primary Examiner*—Stephen J. Lechert, Jr.
*Attorney, Agent, or Firm*—Hopgood, Calimafde

[57] ABSTRACT

A beryllium metal matrix phase includes up to 70% by volume of beryllium oxide single crystals dispersed therein. The composites are useful for electronics applications because of their light weight, high strength and effective thermal properties.

8 Claims, No Drawings

METHOD OF MAKING BERYLLIUM-BERYLLIUM OXIDE COMPOSITES

BACKGROUND OF THE INVENTION

1. The Field of the Invention

The present invention relates to metal ceramic composites, particularly beryllium metal matrix composites having dispersed beryllium oxide particles. Novel processes for fabricating metal ceramic composites are also described. The resulting composites are useful as cores, enclosures, packages and component parts for electronic board applications.

2. State of the Art

Conventional electronic packages typically include an integrated circuit device housed in a cavity formed by structural components which provide physical and electronic insulation from the environment. To accomplish the insulation function, packaging components must exhibit certain physical properties expressed in terms of high modulus and good fracture strength; good dielectric properties; high thermal conductivity (K); low coefficient of thermal expansion and capacity for high density devices. Packaging materials must have surface characteristics which permit brazing or soldering to form a hermetic seal. Light weight and high stiffness are also preferred.

Several known materials have been used for electronic packaging, including 6061-type aluminum, molybdenum and KOVAR, an iron-based metal alloyed with cobalt and nickel. These prior art materials exhibit some, but not all, of the preferred characteristics. Accordingly, the selection of packaging materials typically involved a "trade off" between different physical and thermal properties. In view of the present invention, it is not necessary to compromise one property in favor of another.

Modern packaging materials are now expected to meet high reliability specifications for military and aerospace applications. New manufacturing technologies place additional demands on the physical and thermal requirements of packaging and substrate materials. One manufacturing technique, conventionally known as surface mount technology (SMT), involves the direct application of electronic components to an electric board. For this technique the electronic board must have the necessary mechanical properties to withstand fabrication of the electronic component directly on the board. The board must also maintain its physical integrity to perform the housing and insulation functions.

This direct application technique also requires compatible coefficients of thermal expansion for the electronic component and board. Otherwise, mechanical forces created by differential expansion or contraction during manufacture or subsequent operation may result in a failure of the component-board bond. Under extreme circumstances these mechanical forces may be sufficient to destroy the component parts or board.

SUMMARY OF THE INVENTION

A successful electronic material must provide attractive thermal and mechanical properties with minimum weight. These materials should be useful for innovative manufacturing techniques and normal operation over the useful life of an active component.

Accordingly, it is an object of the present invention to provide a material which has a favorable combination of physical properties for use in high performance electronics applications.

It is a further object of the present invention to provide a novel material having light weight, high thermal conductivity, low coefficient of thermal expansion, high modulus and good mechanical strength.

The present invention provides a novel composite having a beryllium metal matrix phase with beryllium oxide particles dispersed therein. Preferably, the volume loading of beryllium oxide is in the approximate range of 10% to 70%. This novel composition has a thermal conductivity higher than that of beryllium metal, a coefficient of thermal expansion lower than that of beryllium metal and a modulus of at least 35 Msi. These beneficial properties are provided in an isotropic material.

The invention also provides a novel process for making composites including the steps of providing beryllium metal and beryllium oxide powders, mixing the two powders, molding the composite powder and increasing the density by HIP'ing. The resulting composite materials can be machined, rolled, brazed or soldered. Stress relief steps can also be performed.

DETAILED DESCRIPTION OF SPECIFIC EMBODIMENTS

The present invention relates to a composite of beryllium and beryllium oxide. In the composite, the beryllium metal is always present as a continuous phase with the beryllium oxide dispersed therein.

The term "beryllium metal" is defined to include pure beryllium metal as well as commercially available beryllium alloys, especially those including silicon or aluminum. Most preferred are beryllium alloys having at least about 30% by volume of beryllium. Suitable beryllium metal powders are commercially available from Brush Wellman Inc., Elmore, Ohio. They are sold under the trade designations SP-65 and SP-200-F. These products nominally contain at least 98.5 wt.% beryllium. Both powders have a particle size of 95% minus 325 mesh when tested in accordance with ASTM B-214. The SP-200-F has an average mean particle size of about 17 μm, and the SP-65 powder has an average mean particle size of about 20 μm. Trace elements of Fe, Al, Mg and Si are preferred because they increase yield strength and improve sinterability of a beryllium matrix.

Dispersed beryllium oxide is present as small, individual particles with single crystal structures ranging in size from about 1 μm to about 50 μm. An average particle size of about 5–25 μm is preferred, with a particle size distribution such that about 95% (3α) of the particles are within the range of from about 5 microns to about 25 microns. BeO whiskers or other single crystal morphologies can be substituted for some or all of the BeO particles, without changing the properties of the resulting composite.

Particle size and crystallinity of the BeO powder can be controlled to provide desirable properties for the composite material. Single crystal BeO particles can be produced from larger crystals, polycrystalline structures or BeO whiskers. The starting material is wet ground to provide the desired particle size and/or size distribution. A grinding media is readily chosen by the skilled artisan based on the degree and duration of agitation; and the specific liquid medium, mill type and ball diameter. Size fractions are collected by regularly screening the powder. Fine BeO whiskers require only slight grinding. Coarse-grained BeO can be made by heat treating polycrystalline solid material at a temperature near the melting point of beryllium oxide (2570° C.); grain growth can be enhanced by the addition of MgO.

In general, BeO powder can be provided by a number of art-recognized methods. Reasonably pure, well-formed crystals up to ⅝" in length have been grown from lithium molybdate, as described by Austerman, "Growth of Beryllia Single Crystals," *J. Am. Ceramic. Soc.*, Vol. 46, No. 6 (1963). Similar methods are disclosed by Slack, "Thermal Conductivity of BeO Single Crystals," *J. Appl. Phys.*, Vol. 42, No. 12, p. 4713 (1971). Additional techniques for making single crystal BeO are reported by Newkirk, "Studies on the Development of Microcrystals of BeO," UCRL-7245 (May 1963). The resulting microcrystals have a whisker morphology. A reversible reaction of $BeO+H_2O \longleftrightarrow Be(OH)_2$ may also be used for crystal formation. It is described in Ryshkewitch Patent No. 3,125,416. Ganguli, "Crystal Growth of Beryllium Oxide from Borate Melts," *Indian J. of Tech.*, Vol. 7, pp. 320–323 (Oct. 1969) also provides a method for producing BeO whiskers. All of the foregoing are incorporated by reference. Commercially available single crystal BeO powders include GC-HF Beryllium Oxide Powder available from Brush Wellman and ULVAC BeO powder available from Tsukuba Asgal Co., Ltd., Ibaraki, Japan.

The beryllium oxide is present in the matrix at loadings of from about 10% to about 70% by volume. Higher volume fractions of beryllium oxide result in lower thermal expansion coefficients and higher thermal conductivities. It should also be appreciated that processing becomes more difficult with volume fractions of greater than about 60%. Preferred volume loadings are in the range from about 20% to about 60% by volume, more preferably in the range of about 40–60% by volume.

The novel beryllium-beryllium oxide composite material is fabricated by first providing a beryllium metal powder and beryllium oxide powder. Appropriate measures of the powders are placed in a roll blender or V-blender. The ratio of beryllium to beryllium oxide is chosen by the material designer according to property requirements. If a higher thermal expansion coefficient or lower thermal conductivity is required, the amount of beryllium metal is increased relative to the beryllium oxide. As with conventional processing, the input powders must be dry, inclusion-free and without lumps. The mixture of powders is then blended for a few hours to form a homogeneous composite powder.

After the powders are blended, it is preferred that the composite powder be examined to determine if any agglomerations are present. Agglomerated powder is removed by screening or a milling media can be added to the mixture during blending to facilitate deagglomeration. The milling media must not contaminate the powder and should be easily removed. In the present case, a preferred milling media would include 2 cm diameter beryllium oxide spheres. Another method for deagglomerating the powder is to perform the mixing in a liquid medium. If liquid blending is used, the mixture must be thoroughly dried before processing continues.

The composite powder is then formed into a desired shape and densified. Densification is accomplished by conventional HIP'ing techniques, with the resulting billet being further processed into the desired shape with required dimensions. In general, densification is accomplished by first loading a mild steel HIP can with the composite powder. The size and shape of the HIP can is determined by the dimensions of the billet from which the final product is made. The powder may be loaded into the HIP can either manually or with the aid of a mechanical loading device. Conventional processing often includes a vibrating device to facilitate the flow of powder or slip casting a thick slurry into a mold. In the present invention, a slight vibration during loading is acceptable. But, excessive or prolonged vibration can lead to powder deblending.

The HIP can is loaded with the composite powder and attached to a vacuum system for evacuation. At this point it is desirable to check the can for leakage. If no leaks are observed, the can is slowly heated under vacuum to drive off residual moisture and gases from the powder. After degassing, the HIP can is sealed and placed into a HIP unit. The composite powder in the can is densified by heating to about 1000° C. at 15 Ksi for about three hours.

The composite may be HIP'd in the temperature range of 900° C. to 1275° C., more generally from about 900° C. up to the melting point of the beryllium metal or alloy. The minimum pressure for successful densification at 900° C. is about 10 Ksi. At higher HIP temperatures, a lower pressure may be used. For example, at about 1200° C., a HIP pressure of about 5 Ksi is sufficient for densification. The maximum HIP pressure is limited generally by the processing equipment. HIP times depend on both temperature and pressure, with HIP time increasing with decreasing temperature and/or pressure. HIP times of between about two hours and six hours are generally sufficient. HIP'ing is done preferably in an inert atmosphere, such as argon or helium. It should also be noted that the particle size distribution will effect the final density of the HIP'd article, with narrower distributions yielding denser pieces. However, broader particle size distributions can be accounted for by increasing HIP pressure. The present composite may also be densified by hot pressing, although HIP is preferred. The density of the final composition will be generally in the range of about 1.95 $g/cm^3$ to about 2.65 $g/cm^3$. When densification is complete, the sealed can is removed from the now dense beryllium-beryllium oxide billet by leaching in nitric acid or by other known techniques.

The beryllium-beryllium oxide composite billet can be machined into various shapes. For electronic board applications a sheet configuration is the preferred geometry. To accomplish this geometry the composite billet is rolled at about 1000.C to a desired thickness. Sheets may also be formed by sawing small sections from the billet and surface grinding to required tolerances. It is also possible to densify by HIP'ing to the sheet morphology. Conventional machining techniques can be used for the composite materials. It is important to note that the composite material is very abrasive and causes tool wear. For example, EDM cutting rates are very low when used on the present composite material.

Once machined to the desired specifications, the composite article can be plated and/or anodized in a fashion similar to that of beryllium. The novel composites may be stress relieved and flattened with no loss of thermal properties. It will be appreciated that the previously mentioned rolling technique has a detrimental effect on thermal conductivity and the coefficient of thermal expansion for the composite material, but to a small degree.

The composites may be further processed by rolling to decrease the thickness. Rolling may be performed at temperatures generally between 850° C. and 1200° C. The rolling reduction per pass preferably is between 4% and 20%. Rolling ma be done under any non-reactive atmosphere, including air. Preferably rolling is done at about 1000° C. with a reduction per pass of 10% to achieve a total reduction of 90% (i.e., the resulting article has a thickness 10% of the original thickness). Between passes, the article may be annealed at about 760° C.

The composites may also be stress relieved, a standard beryllium metallurgical process which removes certain dislocations and makes the composite less brittle. The invention is further described with reference to the following examples which are provided for illustrative, not limiting purposes.

EXAMPLE 1

This example describes fabricating a Be-BeO composite including about 20 vol.% BeO particles. Approximate amounts of the following powders were mixed for about one hour using a roll blender:

388.3 g. Be powder (Grade SP-65, available from Brush Wellman Inc., Elmore, Ohio)

159.7 g. BeO powder (made by a method similar to that described by Austerman; resulting particles have a mean diameter of 22 μm and an average thickness:-diameter ratio of 2.4)

The blended powder was passed through a −100 mesh screen to break-up and remove agglomerates. The deagglomerated powder was loaded into mild steel HIP cans. The loaded HIP cans were leak-checked, degassed and loaded into a HIP unit. The powder was HIP'd at 1000° C. for 3 hours at a pressure of 15 Ksi. After densification, the HIP can was removed from the densified composite billet by leaching in nitric acid. The now HIP'ed billet was subjected to water immersion and the density was measured at 2.093 g/cc. Thermal and mechanical properties of test specimens cut from this billet are shown in Table 1.

EXAMPLE 2

Following the same general procedure described in Example 1, a Be-BeO composite including about 40 vol.% BeO particles was made. Powders of the following approximate amounts were mixed for about one hour using a roll blender:

291.0 g. Be powder (Grade S-65)

319.5 g. BeO particles (mean dia. of 22 μm)

The procedure of Example 1 was followed through recovery. Using the same water immersion technique, the density was measured at 2.315 g/cc. Thermal and mechanical properties are shown in Table 1.

EXAMPLE 3

The general procedure described in Example 1 was repeated, except that the BeO particles had a mean diameter of 4 microns. The resulting billet had a density of 2.133 g/cc. Other properties are shown in Table 1.

EXAMPLE 4

The general procedure described in Example 2 was repeated, except that the BeO particles had a mean diameter of 4 microns. The resulting billet had a density of 2.344 g/cc. See Table 1 for additional properties.

TABLE 1

| Example | K (W/mK) at 20° C. | CTE (ppm/°C.) −100° to 25° | CTE (ppm/°C.) +25° to 100° C. | Y.S. (Ksi) | U.T.S. (Ksi) | Modulus (Msi) | Elong % |
|---|---|---|---|---|---|---|---|
| 1 | 232 | 7.2 | 10.6 | 58.2 | 58.2 | — | 0.30 |
| 2 | 231 | 6.0 | 8.9 | — | 43.7 | — | 0.11 |
| 3 | 208 | 7.0 | 11.3 | 57.1 | 57.4 | 36.0 | 0.19 |
| 4 | 196 | 5.7 | 8.8 | — | 54.7 | 34.7 | 0.03 |

EXAMPLE 5

The general procedure described in Example 1 was repeated, except that 60 vol.% BeO particles were used. The density of the as-HIP'ed billet was determined by water immersion to be 2.522 g/cc, i.e., greater than 98% of the theoretical density of 2.57 g/cc. Thermal conductivity of the test specimens was measured at 20° C. of 253 W/mK, a CTE from −100° C. to +25° C. of 4.8 ppm/° C. and from +25° C. to 100° C. of 7.3 ppm/° C.

EXAMPLES 6 AND 7

A billet was formed as described in Example 1. The billet was rolled into sheet on a 4- high rolling mill at 100° C. The thickness of the composite material was reduced by 85% after 18 passes through the rolling mill. The resulting sheet was stress relieved at 700° C. for 8 hours. Following the same general procedure, a second billet was formed as described in Example 2 and rolled into sheet. Test specimens were machined from each sheet (20 vol.% and 40 vol.% BeO) and measured in both the longitudinal (L) and transverse (T) directions. These results are shown below in Table 2.

TABLE 2

| Example | K (at 20° C. in W/mK) | CTE (in ppm/°C.) −100° C. to 25° C. | CTE (in ppm/°C.) +25° to +100° C. |
|---|---|---|---|
| 6 | 231 | L: 7.8 | 11.2 |
| | | T: 7.2 | 10.4 |
| 7 | 210 | L: 7.1 | 9.9 |
| | | T: 6.2 | 9.3 |

EXAMPLE 8

A billet was formed as described in Example 2 to make a dense composite, with the exception that the BeO was in the form of fine crystalline agglomerates. The billet was then processed in the manner described in Example 7 to make a composite sheet. Test specimens for the evaluation of the coefficient of thermal expansion were machined from each sheet in both the longitudinal (L) and transverse (T) directions. The test results are shown below.

| Orientation | CTE (ppm/°C.) −100° C. to +25° C. | CTE (ppm/°C.) +25° C. to +100° C. |
|---|---|---|
| L | 6.5 | 9.2 |
| T | 5.9 | 8.4 |

When these results are compared with those shown in Table 2, it is apparent that the thermal properties are unexpectedly improved by using BeO single crystal particles rather than BeO powder.

Various modifications and alterations to the present invention may be appreciated based on a review of this disclosure. These changes and additions are intended to be within the scope and spirit of this invention as defined by the following claims.

What is claimed is:

1. A process for producing a composite composition which comprises:

(a) providing beryllium metal in powdered form;

(b) providing beryllium oxide in powdered form;

(c) mixing the metal powder and the oxide powder to form a composite powder;

(d) forming the composite powder into a desired shape; and (e) densifying the shaped powder by hot isostatic pressing to form a composite composition with a beryllium metal matrix phase having dispersed therein from about 10% to about 70% by volume beryllium oxide.

2. The process defined by claim 1, which further comprises (f) the step of rolling the composite composition into a sheet.

3. The process defined by claim 1, which further comprises the step of stress relieving the composite composition.

4. The process defined by claim 1, which further comprises the step of plating the composite composition.

5. The process defined by claim 1, wherein the composite powder is densified to at least 98% of theoretical density.

6. The process defined by claim 1, wherein the composite powder is densified by heating to about 1000° C. at about 15 Ksi for about 3 hours.

7. The process defined by claim 1, which further comprises the step of screening the composite powder to a desired average particle size.

8. The process defined by claim 1, which further comprises the steps of providing a beryllium oxide powder, wet grinding the powder to a desired average particle size, and removing the desired particles to provide the beryllium oxide in powdered form.

* * * * *